US010385501B2

(12) United States Patent
Seo et al.

(10) Patent No.: US 10,385,501 B2
(45) Date of Patent: Aug. 20, 2019

(54) LAUNDRY TREATMENT APPARATUS

(71) Applicant: LG ELECTRONICS INC., Seoul (KR)

(72) Inventors: Jinwoo Seo, Seoul (KR); Sangjin Kim, Seoul (KR); Jihong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 18 days.

(21) Appl. No.: 15/198,548

(22) Filed: Jun. 30, 2016

(65) Prior Publication Data

US 2017/0002501 A1 Jan. 5, 2017

(30) Foreign Application Priority Data

Jun. 30, 2015 (KR) ..... 10-2015-0092777

(51) Int. Cl.
*D06F 39/04* (2006.01)
*D06F 39/00* (2006.01)
(Continued)

(52) U.S. Cl.
CPC ..... *D06F 39/04* (2013.01); *D06F 37/02* (2013.01); *D06F 37/24* (2013.01); *D06F 37/267* (2013.01);
(Continued)

(58) Field of Classification Search
CPC ..... D06F 37/02; D06F 37/267; D06F 37/28; D06F 39/04; D06F 37/24; D06F 39/005; D06F 37/268; D06F 29/00
See application file for complete search history.

(56) References Cited

U.S. PATENT DOCUMENTS 6,105,403 A * 8/2000 Carow et al. ..... 68/196
9,745,682 B2 * 8/2017 Park et al.
(Continued)

FOREIGN PATENT DOCUMENTS

CN 1610776 4/2005
CN 1676736 10/2005
(Continued)

OTHER PUBLICATIONS

Extended European Search Report issued in European Application No. 16176817.1 dated Nov. 3, 2016, 12 pages.
(Continued)

*Primary Examiner* — Michael E Barr
*Assistant Examiner* — Benjamin L Osterhout
(74) *Attorney, Agent, or Firm* — Fish & Richardson P.C.

(57) ABSTRACT

A laundry treatment apparatus includes a housing. The laundry treatment apparatus further includes a tub. The laundry treatment apparatus further includes a drum. The laundry treatment apparatus further includes a heater. The laundry treatment apparatus further includes a tub through-portion formed in the tub so that the heater is inserted into a space located between a bottom surface of the drum and a bottom surface of the tub. The laundry treatment apparatus further includes three or more first support members. The laundry treatment apparatus further includes second support members that protrude from a circumferential surface of the tub, a number of the second support members being equal to a number of the three or more first support members. The laundry treatment apparatus further includes a plurality of connectors that are each configured to connect a first support member and a second support member.

12 Claims, 8 Drawing Sheets

(51) Int. Cl.

| | |
|---|---|
| ***D06F 37/28*** | (2006.01) |
| ***D06F 37/02*** | (2006.01) |
| ***D06F 37/26*** | (2006.01) |
| ***D06F 37/24*** | (2006.01) |
| *D06F 29/00* | (2006.01) |

(52) U.S. Cl.
CPC ..... *D06F 37/28* (2013.01); *D06F 39/005* (2013.01); *D06F 29/00* (2013.01); *D06F 37/268* (2013.01)

(56) References Cited

U.S. PATENT DOCUMENTS

| | | | | |
|---|---|---|---|---|
| 9,840,799 | B2 * | 12/2017 | Sang et al. | |
| 2004/0083770 | A1 | 5/2004 | Lyu | |
| 2009/0133198 | A1 * | 5/2009 | Lee et al. | 8/158 |
| 2009/0288452 | A1 * | 11/2009 | Lee et al. | 68/12.18 |
| 2010/0011609 | A1 * | 1/2010 | Park et al. | 34/88 |
| 2010/0064736 | A1 | 3/2010 | Jeong et al. | |
| 2010/0101282 | A1 * | 4/2010 | Jeong et al. | 68/139 |
| 2010/0192639 | A1 * | 8/2010 | Kim | D06F 25/00 68/20 |
| 2011/0265524 | A1 * | 11/2011 | Kim et al. | 68/13 R |
| 2013/0047677 | A1 * | 2/2013 | Han et al. | 68/27 |
| 2014/0053612 | A1 * | 2/2014 | Son et al. | 68/28 |
| 2014/0196507 | A1 * | 7/2014 | Lee et al. | 68/27 |
| 2015/0059418 | A1 * | 3/2015 | Lee et al. | 68/17 R |
| 2015/0345063 | A1 * | 12/2015 | Sang et al. | 68/20 |

FOREIGN PATENT DOCUMENTS

| | | |
|---|---|---|
| CN | 100532688 C | 8/2009 |
| CN | 102844486 | 12/2012 |
| CN | 104321481 | 1/2015 |
| EP | 2700743 | 2/2014 |
| EP | 2980297 | 2/2016 |
| JP | 05001481 | 1/1993 |
| KR | 10-0336394 | 5/2002 |
| KR | 10-0716249 | 5/2007 |
| TW | 200602530 | 1/2006 |

OTHER PUBLICATIONS

International Search Report and Written Opinion in International Application No. PCT/KR2016/007028, dated Sep. 12, 2016, 16 pages.

Taiwan Office Action in Taiwan Application No. 105118997, dated Jun. 26, 2017, 17 pages (with English translation).

Chinese Office Action in Chinese Application No. 2016105010729.2, dated Feb. 13, 2018, 16 pages.

* cited by examiner

【 FIG 1】
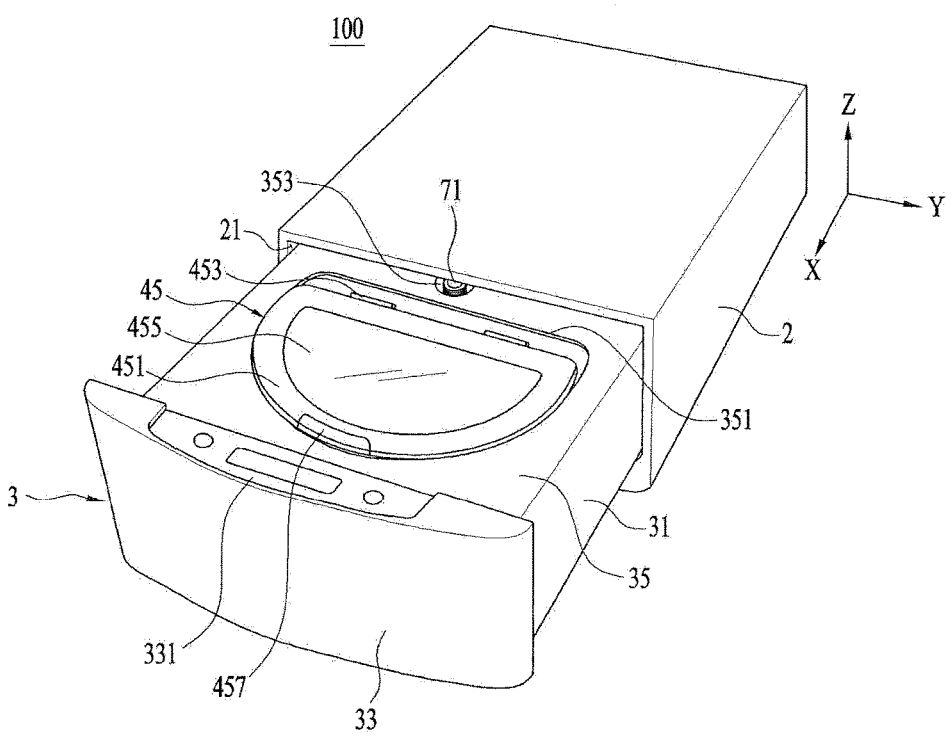

【 FIG 2】
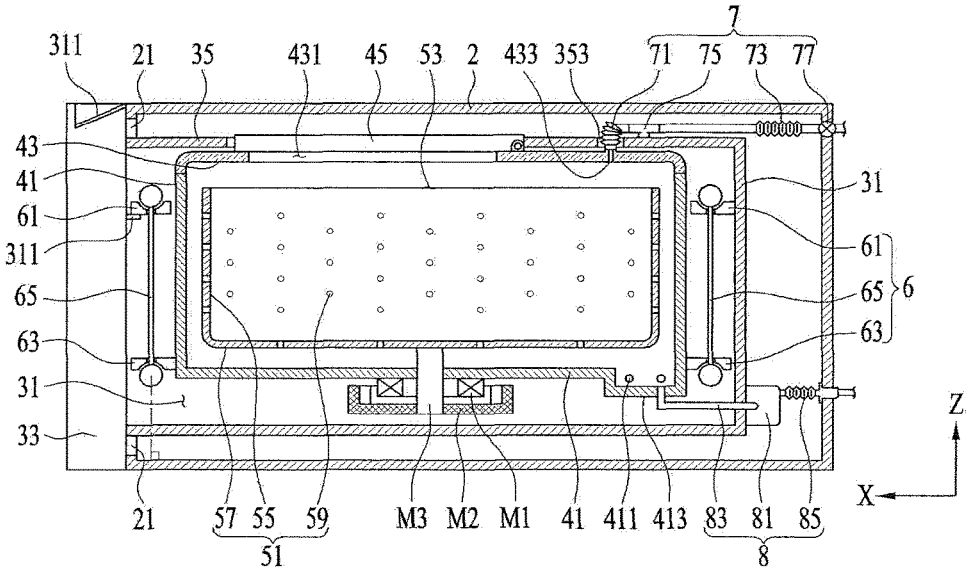

【 FIG 3】
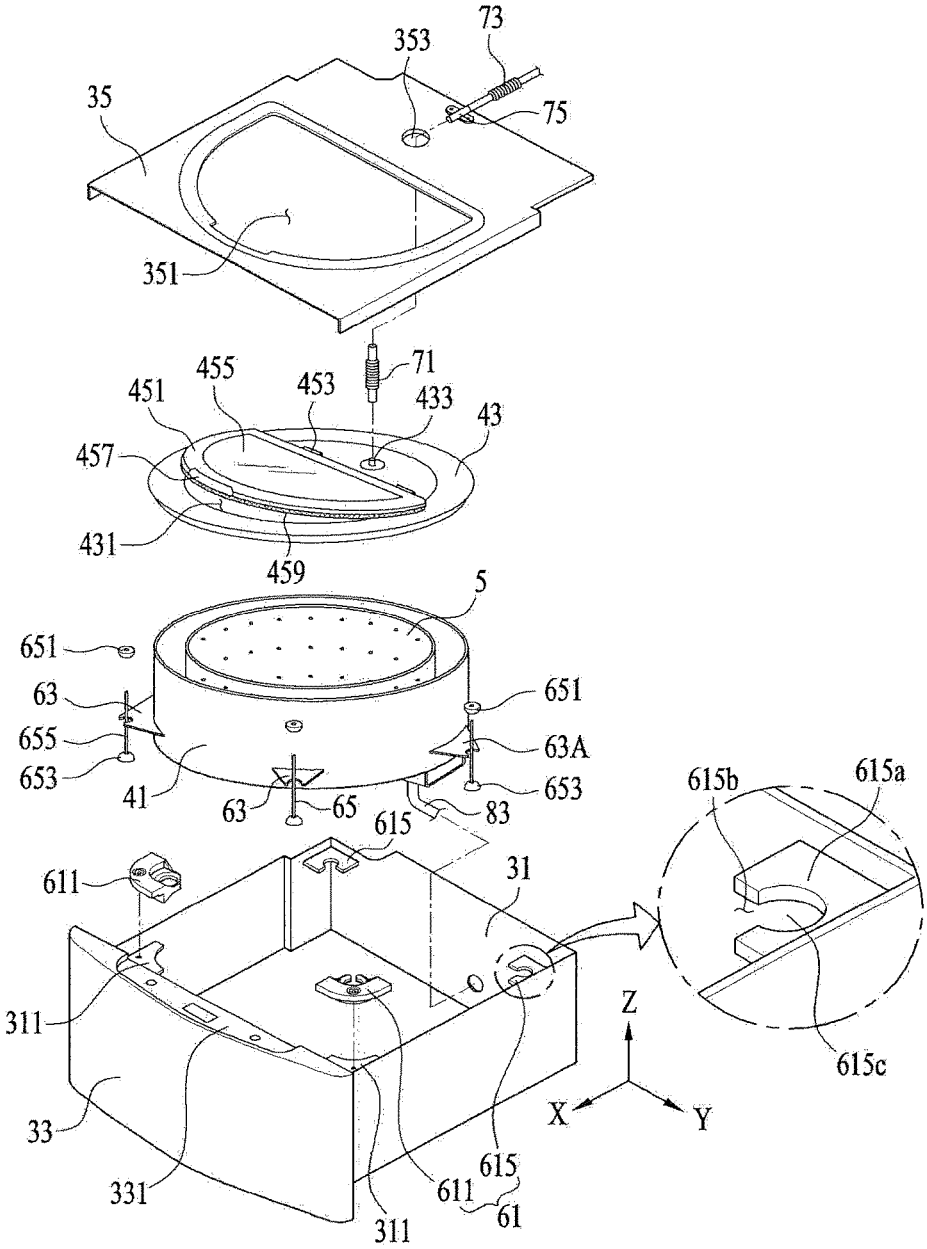

【 FIG 4】
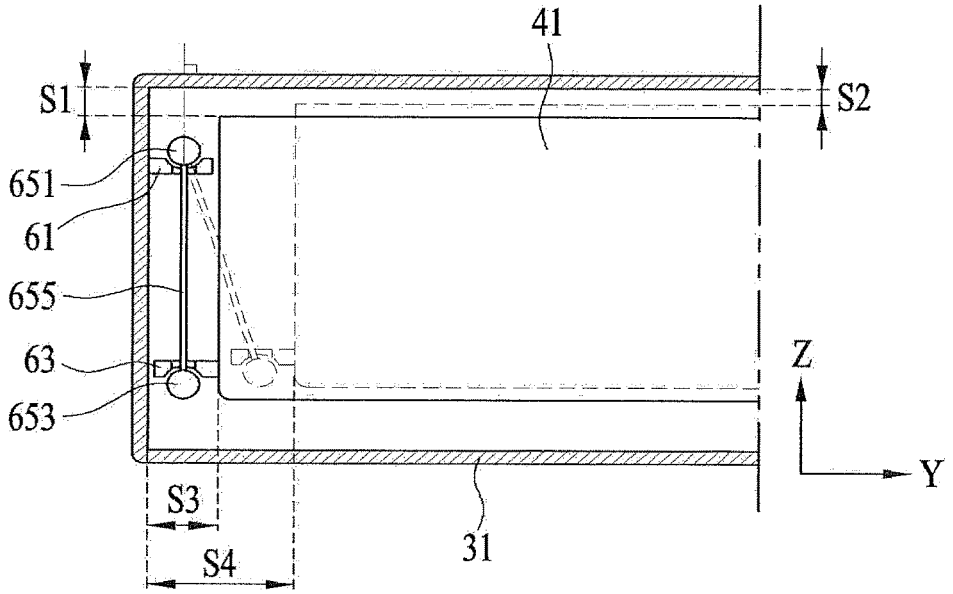

【 FIG 5】
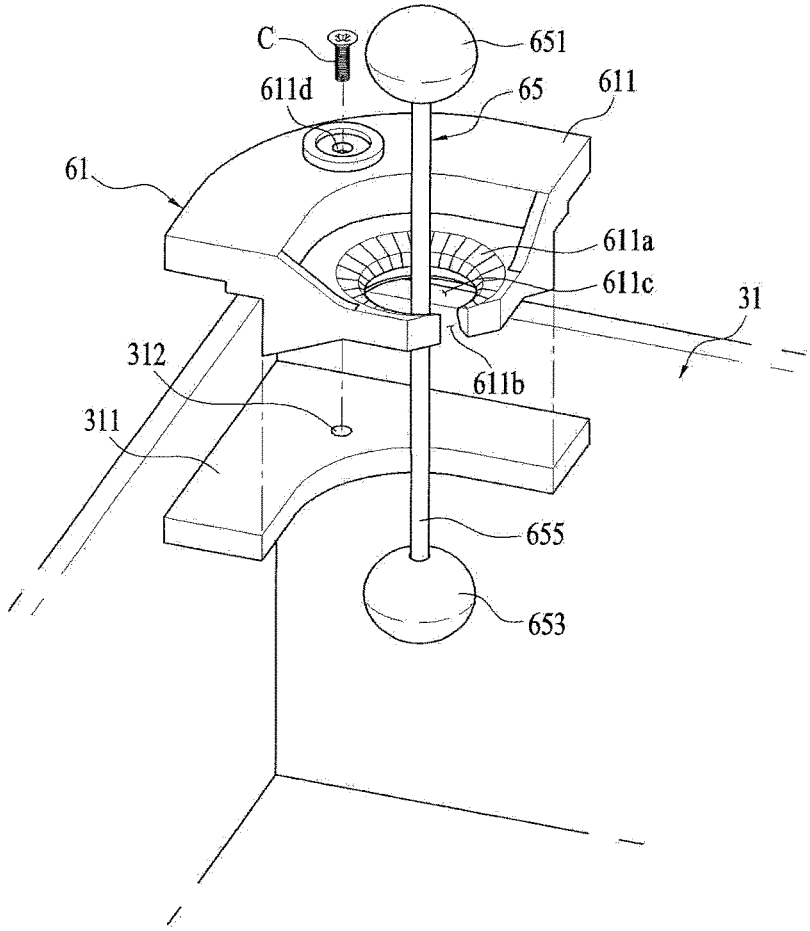

FIG 6(a)
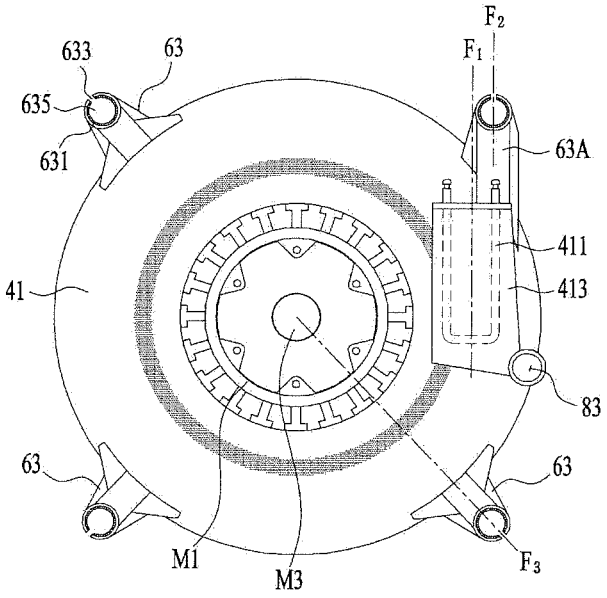
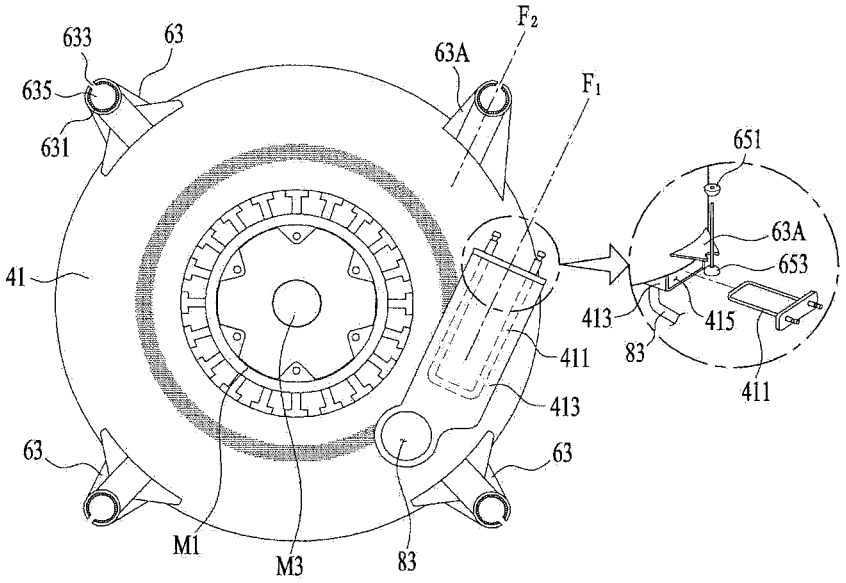
FIG 6(b)

FIG 7(a)
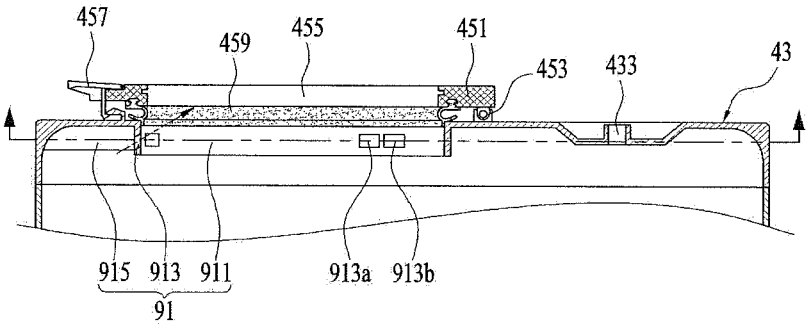
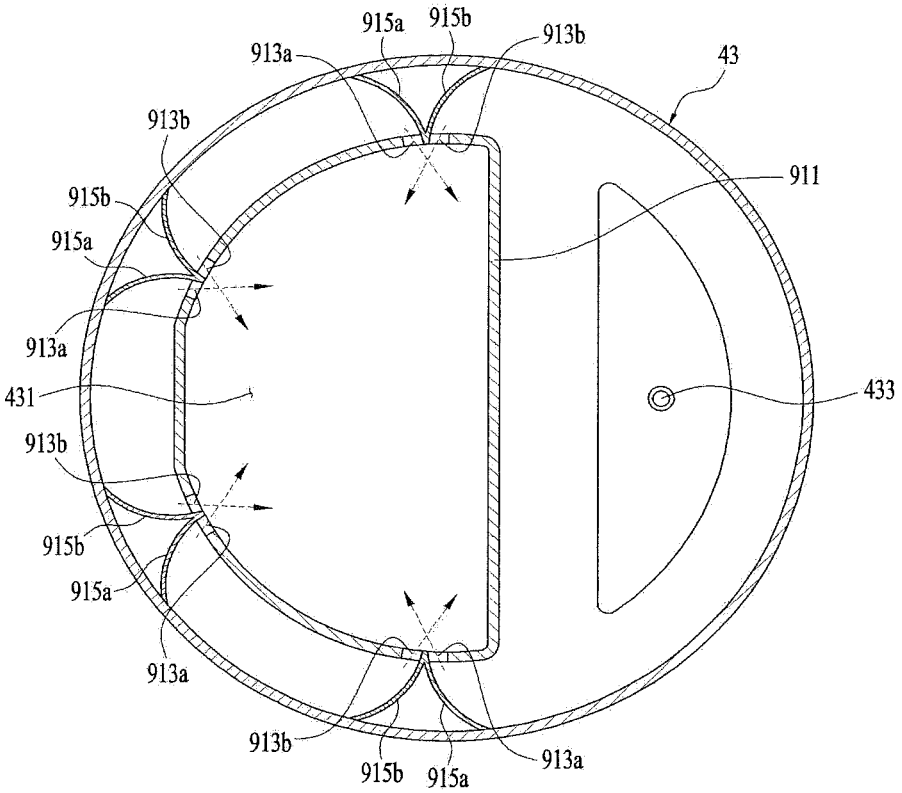
FIG 7(a)

【 FIG 8】
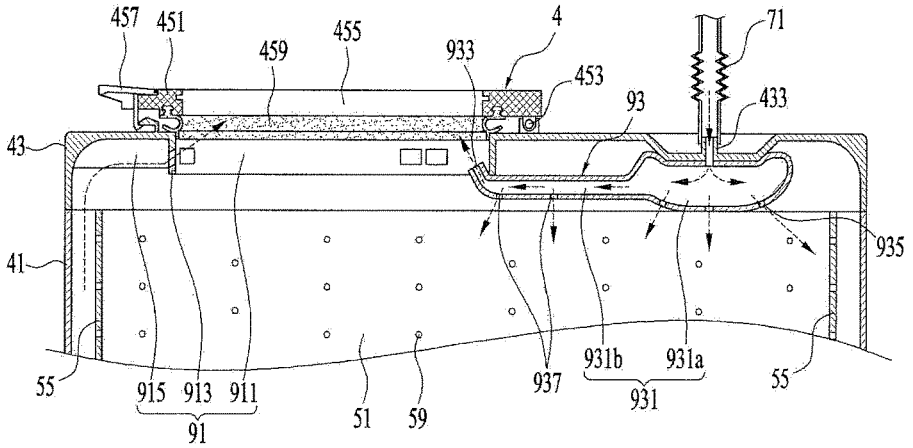

LAUNDRY TREATMENT APPARATUS

CROSS REFERENCE TO RELATED APPLICATION

This application claims the benefit of Korean Patent Application No. P10-2015-0092777, filed on, Jun. 30, 2015, which is hereby incorporated by reference as if fully set forth herein.

FIELD

The present disclosure relates to a laundry treatment apparatus.

BACKGROUND

Generally, a laundry treatment apparatus is a generic term for an apparatus that washes laundry (e.g. objects to be washed or objects to be dried), an apparatus that dries laundry, and an apparatus that may perform both washing and drying of laundry.

Conventional laundry treatment apparatuses are classified into front loading type laundry treatment apparatuses configured such that laundry is introduced through an introduction opening formed in the front surface of the apparatus, and top loading type laundry treatment apparatuses configured such that laundry is introduced through an introduction opening formed in the upper surface of the apparatus.

A top loading type laundry treatment apparatus includes a cabinet, a tub provided inside the cabinet and having an introduction opening in the upper surface thereof, a drum rotatably provided inside the tub, and a door for opening and closing the introduction opening.

In the conventional laundry treatment apparatus having the configuration described above, the tub is fixed inside the cabinet using a tub support unit. However, a conventional tub support unit cannot effectively prevent the tub from vibrating in the height direction of the cabinet.

In addition, some conventional laundry treatment apparatuses are devised to have a minimum volume in order to wash only a very small amount of laundry. Such a laundry treatment apparatus having a minimum volume has the feature of a very small distance between the introduction opening and the upper end of the drum. Therefore, impurities, which are generated inside the tub when the drum is rotated to wash laundry, remain on the door.

In addition, the conventional laundry treatment apparatus having a minimum volume makes it difficult to provide the tub with a heater for increasing the efficiency of washing.

In particular, in the case where the conventional laundry treatment apparatus is of a top loading type, the heater must be provided on the bottom surface of the tub. However, it may be difficult to acquire sufficient space for the provision of the heater.

In addition, the conventional laundry treatment apparatus has a problem in that the space for receiving the heater therein and a member for fixing the tub to the cabinet may not be injection molded using the same mold.

In addition, in the conventional laundry treatment apparatus, water is not supplied to the heater, which problematically causes overheating of the heater.

In addition, the conventional laundry treatment apparatus having a minimum volume has a narrow space between the bottom surface of the drum and the bottom surface of the tub, which may cause damage to the heater due to the rotation of the drum.

SUMMARY

According to an innovative aspect of the subject matter described in this application, a laundry treatment apparatus includes a housing; a tub that is located inside the housing and that is configured to receive water; a drum that is configured to rotate, that is located inside the tub, and that is configured to receive laundry; a heater that is configured to heat water in the tub; a tub through-portion formed in the tub so that the heater is inserted into a space located between a bottom surface of the drum and a bottom surface of the tub; three or more first support members that are located at the housing; second support members that protrude from a circumferential surface of the tub, a number of the second support members being equal to a number of the three or more first support members; and a plurality of connectors that are each configured to connect a first support member and a second support member, where at least one of the second support members protrudes from the circumferential surface of the tub in a direction that is parallel to a direction in which the tub through-portion is configured to receive the heater.

The laundry treatment apparatus may include one or more of the following optional features. The laundry treatment apparatus includes a receiving portion protruding from the bottom surface of the tub so as to extend away from the bottom surface of the drum for providing a space in which the heater is received, the receiving portion having the tub through-portion therein. The receiving portion is provided so that the direction in which the heater is inserted faces away from a center of rotation of the drum. Each of the plurality of connectors defines a right angle with respect to a bottom surface of the housing. The laundry treatment apparatus includes two first brackets provided on one surface of the housing so as to be separably coupled to the housing; and two second brackets provided on a surface of the housing facing the surface on which the first brackets are provided. Each connector includes: a first connection piece configured to sit on the first support member; a second connection piece configured to support the second support member; and a bar that connects the first connection piece and the second connection piece to each other, the bar forming a right angle with respect to a bottom surface of the housing.

Each first support member includes a bracket that is located at the first connector and that is configured to connect to the housing. The bracket includes a first bracket that is configured to connect to a front surface of the housing, and a second bracket that is configured to connect to the front surface of the housing. Each first support member includes a front bracket that is connected to a front surface of the housing and a rear bracket that is connected to a rear surface of the housing. The front bracket includes a first front bracket that is located at the front surface of the housing, and a second front bracket that is located at the front surface of the housing. The rear bracket includes a first rear bracket that is located at the rear surface of the housing, and a second rear bracket that is located at the rear surface of the housing. The laundry treatment apparatus includes a cabinet that defines a space configured to receive the housing. The housing is configured to separate from the cabinet.

The tub includes a tub body that includes the second support members and that is configured to receive water; a tub cover that defines an upper surface of the tub body and that defines an introduction aperture; and a door that is configured to open and close the introduction aperture. The laundry treatment apparatus includes a rotating shaft that defines a right angle with respect to a bottom surface of the tub body and that is configured to rotate the drum; and an ejection unit that is configured to discharge, towards the door, water that moves towards the tub cover based on the drum rotating. The tub through-portion is located at an end of the receiving portion and is parallel to the bottom surface of the tub. The tub through-portion is located under the at least one second support member. The tub through-portion is located below and not directly under the at least one second support member. The receiving portion has a hexahedral shape. The tub through-portion has a rectangular shape. The heater is "C"-shaped. Each end of the heater protrudes out of the receiving portion through the tub through-portion. The receiving portion is connected to a drain pipe that is configured to discharge water from the tub.

One object of the subject matter described in this application is to provide a laundry treatment apparatus, which may have a minimum volume and may provide a space for installing a heater on the bottom surface of a tub.

In addition, another object of the subject matter described in this application is to provide a laundry treatment apparatus, which may have a minimum volume and may ensure easy insertion of a heater into a tub.

In addition, another object of the subject matter described in this application is to provide a laundry treatment apparatus, which may realize the simultaneous injection molding of a connector, which supports a tub, and a receiving portion, which provides a space for the installation of a heater.

In addition, another object of the subject matter described in this application is to provide a laundry treatment apparatus, which may have a minimum volume and may increase the volume of a receiving portion that provides the space for the installation of a heater.

In addition, another object of the subject matter described in this application is to provide a laundry treatment apparatus, which may allow the injection molding of a connector and a receiving portion using a single mold.

In addition, another object of the subject matter described in this application is to provide a laundry treatment apparatus, which may prevent overheating of a heater and may prevent damage to the heater from the bottom surface of a drum while the drum is rotated.

In addition, another object of the subject matter described in this application is to provide a laundry treatment apparatus, which may effectively control vibration of a tub in which laundry is received.

In addition, a further object of the subject matter described in this application is to provide a laundry treatment apparatus, which may prevent impurities, generated inside a tub during washing, from remaining on a door, which is used to open and close an introduction opening.

BRIEF DESCRIPTION OF THE DRAWINGS

FIGS. 1 and 2 are views of example laundry treatment apparatuses.

FIG. 3 is a view of an example coupling structure of a housing, a tub, and a drum.

FIG. 4 is a view of an example tub support unit.

FIG. 5 is a view of an example first support member that is located in a tub support unit.

FIGS. 6(*a*) and 6(*b*) are views of example second support members that are located in a tub support unit.

FIGS. 7(*a*), 7(*b*), and 8 are views of example ejection units.

DETAILED DESCRIPTION

An example laundry treatment apparatus includes a housing, a tub provided inside the housing for storing water therein, a drum rotatably provided inside the tub for storing laundry therein, and a tub support unit for allowing the tub to be supported inside the housing.

Although the housing may be configured as a cabinet defining a space, in which the tub may be received, therein, as illustrated in FIG. 1, the housing 3 may be configured as a drawer, which may be discharged from a cabinet 2. The following description will focus on the case wherein the housing 3 is a drawer configured so as to be discharged from the cabinet 2.

The cabinet 2 may serve to define the external appearance of the laundry treatment apparatus 100, and may be a space in which the housing 3 may be received. In some implementations, the cabinet 2 may be provided in the front surface thereof with an opening 21, through which the housing 3 is inserted.

The housing 3 includes a housing body 31 configured to be inserted to the inside of the cabinet 2 through the opening 21, a housing panel 33 fixed to the front surface of the housing body 31 for opening and closing the opening 21, and a housing cover 35 for forming the upper surface of the housing body 31.

Because the housing panel 33 is fixed to the front surface of the housing body 31, the housing panel 33 may serve as a handle for discharging the housing body 31 from the cabinet 2.

The housing panel 33 may be provided with a control panel 331, which is used to input a control command associated with the operation of the laundry treatment apparatus 100 and to notify a user of a message associated with the operation of the laundry treatment apparatus 100.

The housing body 31 may have any shape so long as it can be inserted into the cabinet 2 through the opening 21 and can provide a space in which a tub 4 is received. FIG. 1 illustrates the housing body 31 having an empty hexahedral shape by way of example.

The housing cover 35 has a first through-hole 351 and a second through-hole 353 for communicating the inside of the housing body 31 with the outside. The first through-hole 351 is provided for the introduction and discharge of laundry, and the second through-hole 353 is provided to supply water required to wash the laundry. A detailed description related thereto will follow.

As illustrated in FIG. 2, the tub 4 includes a tub body 41 located inside the housing body 31 for storing water therein, and a tub cover 43 for forming the upper surface of the tub body 41. The tub body 41 may take the form of a cylinder having an open upper surface. The tub body 41 may be provided in the bottom surface thereof with a receiving portion 413 in which a heater 411 is received.

The receiving portion 413 communicates with the outside through a tub through-hole 415. The heater 411 is inserted into a space between the bottom surface of the drum and the bottom surface of the tub through the tub through-hole 415.

The tub cover 43 may have an introduction aperture 431 for communicating the inside of the tub body 41 with the outside of the tub body 41, and a supply aperture 433 for introducing water into the tub body 41.

The introduction aperture 431 may be provided so as to communicate with the first through-hole 351 provided in the housing cover 35, and the supply aperture 433 may be provided so as to communicate with the second through-hole 353 provided in the housing cover 35. That is, the introduction aperture 431 may be located under the first through-hole 351, and the supply aperture 433 may be located under the second through-hole 353.

The introduction aperture 431 serves to allow laundry to be introduced into the tub body 41, or to allow the laundry inside the tub body 41 to be discharged to the outside of the tub body 41. The introduction aperture 431 is opened and closed by a door 45.

As illustrated in FIG. 3, the door 45 may include a frame 451 rotatably coupled to the tub cover 43 via a hinge 453, a window 455 provided in the frame 451, and a door handle 457 for separably coupling the frame 451 to the tub cover 43. The window 455 may be formed of a transparent material to allow the user to view the inside of the tub body 41.

The window 455 may be formed of a transparent material so as to allow the user to view the inside of the tub body 41 when the housing 3 is discharged from the cabinet 2.

In order to prevent the water inside the tub body 41 from being discharged to the outside of the tub body 41 through the introduction aperture 431, any one of the frame 451 and the tub cover 43 may be provided with a sealing unit 459 for hermetically sealing a space between the frame 451 and the introduction aperture 431 when the door 45 closes the introduction aperture 431.

The drum 5, which is provided inside the tub 4, may include a cylindrical drum body 51 having an opening 53 formed in the upper surface thereof. Because the opening 53 is located below the introduction aperture 431, the laundry supplied through the introduction aperture 431 may be supplied to the drum body 51 through the opening 53.

As illustrated in FIG. 2, a plurality of drum through-holes 59 may be provided in a bottom surface 57 and a circumferential surface 55 of the drum body 51 for communicating the inside of the drum body 51 with the tub body 41.

The drum body 51 may be rotated inside the tub body 41 by a drive unit. The drive unit may include a stator M1 located outside the tub body 41 and fixed to the bottom surface of the tub body 41, a rotor M2 configured to be rotated by a rotating magnetic field provided by the stator M1, and a rotating shaft M3 penetrating the bottom surface of the tub body 41 for connecting the bottom surface 57 of the drum 5 and the rotor M3 to each other. In some implementations, the rotating shaft M3 may form a right angle with respect to the bottom surface of the tub body 41.

The tub 4 having the configuration described above may be coupled to the housing body 31 via a tub support unit 6. The tub support unit 6 may include a first support member 61 provided at the housing body 31, a second support member 63 provided at the tub body 41, and a connector 65 for connecting the first support member 61 and the second support member 63 to each other.

As illustrated in FIG. 3, the connector 65 may include a first connection piece 651 configured so as to be seated in the first support member 61, a second connection piece 653 for supporting the second support member 63, and a bar 655 for connecting the first connection piece 651 and the second connection piece 653 to each other.

The first connection piece 651 may be shaped so as to be movable in the first support member 61 while being seated in the first support member 61. The second connection piece 653 may be shaped so as to support the second support member 63 and to be movable in the second support member 63.

FIG. 3 illustrates the first connection piece 651 and the second connection piece 653, which have a semispherical surface in contact with the respective support members 61 and 63 by way of example, and FIG. 4 illustrates the first connection piece 651 and the second connection piece 653, which have a spherical shape by way of example.

As illustrated in FIG. 4, the respective support members 61 and 63 may be provided at a position so that the bar 655 forms a right angle with respect to the bottom surface of the cabinet 2 (e.g. a position so that the bar 655 forms a right angle with respect to the bottom surface of the housing 3).

In some implementations, because at least three tub support units 6 are provided to couple the tub body 41 to the housing body 31 and the bars 655 form a right angle with respect to the bottom surface of the housing body 31, the distance between the tub cover 43 and the housing cover 35 may be increased compared to the case where the bars 655 are tilted by a prescribed angle relative to the Z-axis (S1>S2).

In some implementations, the tub support units 6 may reduce the possibility of the tub cover 43 colliding with the housing cover 35 even if the tub body 41 vibrates inside the housing body 31.

When the bars 655 are provided so as to form a right angle with respect to the bottom surface of the housing body 31, some of the first support members 61 may be separably coupled to the housing body 31.

When at least three tub support units 6 are provided and the first support members 61 are not separable from the housing body 31, a worker who attempts to fix the tub body 41 to the housing body 31 first needs to insert the tub body 41 into the housing body 31 so as to prevent the first support members 61 from interfering with the second support members 63, and thereafter needs to rotate the tub body 41 so that the second support members 63 and the first support members 61 are located on the vertical axis, in order to couple the first connection pieces 651 to the first support members 61.

Although the feature by which the bars 655 of the tub support units 6 form a right angle with respect to the bottom surface of the housing 3 serves to minimize the distance between the outer circumferential surface of the tub body 41 and the inner circumferential surface of the housing body 31 (S3<S4) so as to minimize the volume of the laundry treatment apparatus 100, the strength of assembly of the first connection pieces 651 and the first support members 61 may be deteriorated while the process described above is performed. This problem may be solved by making some of the first support members 61 be separable from the housing body 31.

FIG. 3 illustrates the case where four tub support units 4 are provided by way of example. In some implementations, the first support members 61 may include a pair of first brackets 611 arranged on the surface on which the housing panel 33 is located (e.g. the front surface of the housing 3), and a pair of second brackets 615 arranged on the rear surface of the housing 3. When the housing body 31 has a hexahedral shape, the two first brackets 611 and the two second brackets 615 may be provided at the respective corners of the housing body 31.

In some implementations, the pair of first brackets 611 may be arranged on the left side surface of the housing body 31, and the pair of second brackets 615 may be arranged on the right side surface of the housing body 31.

In some implementations, at least one pair of the first brackets 611 and the second brackets 615 may be separably coupled to body separable coupling pieces 311 fixed to the housing body 31 (when three tub support units 6 are provided, at least one first support member 61 may be separably coupled to the housing body 31).

FIG. 3 illustrates, by way of example, the case where the pair of first brackets 611 is separable from the housing body 31, but the pair of second brackets 615 is not separable from the housing body 31.

When the first brackets 611 are separably coupled to the body separable coupling pieces 311, the coupling of the tub body 41 and the housing body 31 may be performed as follows.

The worker couples the connectors 65 to the four second support members 63 provided on the circumferential surface of the tub body 41, and then couples a pair of connectors 65, selected from among the four connectors 65, to the second brackets 615 arranged on the rear surface of the housing 3.

Once a pair of the first connection pieces 651 is seated on the respective second brackets 615, the worker may couple the tub body 41 and the housing body 31 to each other by coupling the first brackets 611 to the two remaining connectors 65, and then fixing the first brackets 611 to the body separable coupling pieces 311.

In some implementations, the laundry treatment apparatus may prevent the possibility of deterioration in the strength of assembly of the tub body 41 and the housing body 31 by arranging the connectors 65 so as to form a right angle with respect to the bottom surface of the housing 3.

In order to improve the strength of assembly of the tub body 41 and the housing body 31, the first brackets 611 may be integrally formed with the connectors 65. That is, when the worker attempts to assembly the tub body 41 and the housing body 31 with each other, the first brackets 611 coupled to the first connection pieces 651 may be provided to the worker. Each of the first brackets 611 may include a receiving recess for supporting the first connection piece 651, a through-hole for the penetration of the bar 655, and a connector cover for preventing the first connection piece 651 supported in the receiving recess from being separated from the receiving recess.

In order to ensure that the tub body 41 coupled via the tub support units 6 described above is movable in the X-Y plane, each of the second brackets 615 may include a through-hole 615*c* for the penetration of the bar 655 of the connector 65, a receiving recess 615*a* for supporting the first connection piece 651, and a slit 615*b* for allowing the bar 655 to be inserted toward the center of the through-hole 615*c* from the edge of the through-hole 615*c*.

The first bracket 611 may have the same shape as the second bracket 615. That is, as illustrated in FIG. 5, the first bracket 611 may include a through-hole 611*c* for the penetration of the bar 655 of the connector 65, a receiving recess 611*a* for supporting the first connection piece 651, and a slit 611*b* for allowing the bar 655 to be inserted toward the center of the through-hole 611*c* from the edge of the through-hole 611*c*.

The first bracket 611 may be coupled to the body separable coupling piece 311 via a fastening structure. The fastening structure may include a first fastening hole 611*d* formed in the first bracket 611, a second fastening hole 312 formed in the body separable coupling piece 311, and a coupler C inserted through the respective fastening holes.

As illustrated in FIG. 6(*a*), each of the second support members 63 provided at the tub body 41 may include a receiving recess 631 configured so as to be seated on the second connection piece 653, a through-hole 635, into which the bar 655 of the connector 65 is inserted, and a slit 633 for allowing the bar 655 to be inserted toward the center of the through-hole 635 from the edge of the through-hole 635.

Because the first support member 61 and the second support member 63 described above serve as support points for the connector 65 when the tub body 41 vibrates, the lower amount of friction between the first support member 61 and the first connection piece 651 and the lower amount of friction between the second support member 63 and the second connection piece 653 may be more advantageous. Accordingly, the first support member 61 and the second support member 63 may be formed of a self-lubricating material.

However, in consideration of the fact that the first support member 61 is formed of the same material as the housing body 31 via injection molding and that the second support member 63 is formed of the same material as the tub body 41 via injection molding, only the first connection piece 651 and the second connection piece 653 may be formed of a self-lubricating material, or only the first bracket 611, the first connection piece 651, and the second connection piece 653 may be formed of a self-lubricating material.

As illustrated in FIG. 6(*b*), the second support members 63 protrude from the circumferential surface of the tub body 41. At least one 63A of the second support members 63 may protrude from the circumferential surface of the tub body 41 in a direction F2 that is parallel to a direction F1 in which the heater 411 is inserted into the receiving portion 413 (e.g. a direction in which the heater 411 is separated from the receiving portion 413).

When the second support member 63A protrudes in a direction that is not parallel to the direction F1 in which the heater 411 is assembled into the receiving portion 413, it may be difficult to manufacture the tub body 41 via injection molding, or it may be necessary to increase the number of cores provided in a mold.

In order to provide any one 63A of the second support members in the direction parallel to the direction in which the heater 411 is assembled, it is necessary to set the protruding direction F2 of the second support member 63A to the assembly direction F1 of the heater 411, or to set the assembly direction F1 of the heater 411 to the protruding direction F2 of the second support member 63A.

In order to support the tub body 41 in the most stable state, the second support members 63 need to be radially arranged on the circumferential surface of the tub body 41 and need to be spaced apart from one another by the same angle. That the second support members 63 are radially arranged on the circumferential surface of the tub body 41 means that all of the second support members 63 are provided at symmetrical positions about the rotating shaft M3, which is located at the center of the bottom surface of the tub body 41. Accordingly, when all of the second support members 63 are radially arranged on the circumferential surface of the tub body 41, the assembly direction of the heater 411 may be the direction F3 in which the heater 411 is assembled toward the rotation center of the drum 5.

In some implementations, when the assembly direction of the heater 411 is set to the direction in which the second support member 63 protrudes from the circumferential surface of the tub body 41, the length of the receiving portion 413 in which the heater 411 is received is limited by the stator M1, which is fixed underneath the bottom surface of the tub body 41.

Because the height that the receiving portion 413 may protrude from the bottom surface of the tub body 41 is limited (e.g. the thickness of the heater 411 is limited) when the laundry treatment apparatus 100 has a minimum volume, it is difficult to configure the heater 411 to have a long length when the length of the receiving portion 413 is reduced, which may make it difficult to mount a heater having a high heat emission capacity per unit time.

Although the above-described limitation disappears when the receiving portion 413 does not protrude from the bottom surface of the tub body 41 unlike the illustration of FIG. 6, it is inevitable that the receiving portion 413 protrudes from the bottom surface of the tub body 41 in consideration of the fact that the receiving portion 413 serves to prevent overheating of the heater 411 by allowing water introduced into the tub body 41 to first be supplied to the heater 411 and also serves to prevent damage to the heater 411 by the bottom surface 57 of the drum 5 during rotation of the drum 5.

In consideration of the state described above, the receiving portion 413 may protrude from the bottom surface of the tub body 41 so as not to extend toward the center of rotation of the drum 3 (e.g. the position at which the rotating shaft M3 is located), and any one 63A of the second support members 63 may protrude from the circumferential surface of the tub body 41 in the direction F2, which is parallel to the longitudinal direction of the receiving portion 413 (e.g. the direction F1 in which the heater 411 is assembled and which forms a right angle with respect to the tub through-portion 415).

In this way, the length of the receiving portion 413 may not be limited by the position of the stator M1, and the tub body 41 may be manufactured via injection molding.

The tub body 41 may have any of various configurations, as illustrated in FIG. 6, for ensuring that the heater 411 is assembled in the direction F1 so as not to extend toward the center of the bottom surface of the tub body 41 (e.g. toward the position at which the rotating shaft M3 is located) and that any one 63A of the second support members 63 protrudes from the direction, which is parallel to the assembly direction F2 of the heater 411.

The laundry treatment apparatus 100 having the configuration described above may supply water to the tub 4 via a water supply unit 7, and may discharge water stored in the tub 4 to the outside of the cabinet 2 via a drain unit 8.

As illustrated in FIG. 2, the water supply unit 7 may include a first water supply pipe 71 connected to the supply aperture 433 formed in the tub cover 43, a second water supply pipe 73 connected to a water supply source, which is located at the outside of the cabinet 2, and a connection pipe 75 fixed to the tub cover 43 for connecting the first water supply pipe 71 and the second water supply pipe 73 to each other.

The first water supply pipe 71 may connect the supply aperture 433 and the connection pipe 75 to each other through the second through-hole 353 provided in the housing cover 35. The first water supply pipe 71 may be a corrugated pipe in order to prevent the first water supply pipe 71 from being separated from the connection pipe 75 when the tub 4 vibrates (see FIG. 3).

In addition, the second water supply pipe 73 may also be a corrugated pipe in order to prevent the second water supply pipe 73 from being separated from the connection pipe 75 when the housing 3 is discharged from the cabinet 2. The second water supply pipe 73 may be opened and closed by a water supply valve 77, which is controlled by a controller.

In some implementations, the water supply unit 7 may include a single water supply pipe for connecting a water supply source, which is located at the outside of the cabinet 2, to the supply aperture 433 provided in the tub cover 43. In some implementations, the water supply pipe may be a corrugated pipe.

The drain unit 8 may include a drain pump 81 fixed to the housing body 31, a first drain pipe 83 for guiding water inside the tub body 41 to the drain pump 81, and a second drain pipe 85 for guiding water discharged from the drain pump 81 to the outside of the cabinet 2. In some implementations, the second drain pipe 85 may be a corrugated pipe.

In the laundry treatment apparatus 100 having the configuration described above, after laundry is introduced into the drum 5 and water and detergent are supplied to the tub 4, the drum 5 is rotated via the drive unit so as to wash the laundry.

Because a water stream is generated inside the tub 4 while the drum 5 is rotated, there is the possibility that bubbles, which are generated as the detergent is dissolved, or contaminants discharged from the laundry during washing may remain on the door 45 after the washing is completed.

When the bubbles or contaminants remain on the inner surface of the door 45 despite the completion of washing, the user may misjudge that the washing of laundry is not completed or may suspect the failure of the laundry treatment apparatus 100.

To solve the problem described above, the laundry treatment apparatus 100 may further include an ejection unit for removing impurities (bubbles, contaminants or the like) remaining on the door 45.

The ejection unit may include any one of an ejection unit 91 illustrated in FIGS. 7(*a*) and 7(*b*) and an ejection unit 93 illustrated in FIG. 8, or may include both the ejection units 91 and 93 illustrated in FIGS. 7(*a*), 7(*b*), and 8.

The ejection unit 91 illustrated in FIGS. 7(*a*) and 7(*b*) serves to wash the door 45 using centrifugal force generated while the drum 5 is rotated.

In the drum 5, because the rotating shaft M3, which forms the center of rotation, forms a right angle with respect to the bottom surface of the tub body 41, water inside the tub 4 is moved upward along the circumferential surface of the tub body 41 by centrifugal force while the drum 5 is rotated, and thereafter is moved to the introduction aperture 431 along the tub cover 43.

The ejection unit 91 serves to discharge the water, moved to the tub cover 43 by centrifugal force, in the direction in which the door 45 is located, thereby washing the door 45.

The ejection unit 91 of FIGS. 7(*a*) and 7(*b*) may include a guide 915 extending from the edge of the tub cover 43 toward the introduction aperture 431, and a discharge structure 911 and 913 for discharging the water, moved along the guide 915, in the direction in which the door 45 is located.

The discharge structure may include a barrier 911 protruding from the tub cover 43 toward the drum 5, and a discharge hole 913 formed in the barrier 911 for the discharge of water toward the door 45.

The barrier 911 may be provided so as to surround the entire introduction aperture 431, or may be provided so as to intermittently surround the introduction aperture 431. The expression "to intermittently surround" means that a plurality of barriers is spaced apart from one another along the edge of the introduction aperture.

FIG. 7(*b*) illustrates an example where the barrier 911 surrounds the entire introduction aperture 431. In some implementations, the barrier 911 may protrude from the edge of the introduction aperture 431 toward the drum 5.

When the door 45 is rotatably coupled to the upper surface of the tub cover 43 so that the inner surface of the door 45 (e.g. one surface of the door 45 in contact with water) is located higher than the discharge hole 913, the discharge hole 913 may be inclined by a prescribed angle so as to allow water to be discharged toward the door 45.

In some implementations, when the door 45 includes the window 455 forming of a transparent material, because the user will attempt to check whether impurities remain through the window 455, the discharge hole 913 may be inclined so as to allow water to be discharged to the window 455.

The guide 915 may include a first guide 915*a* and a second guide 915*b*. The first guide 915*a* guides water, moved to the edge of the tub cover 43, to the discharge hole 913 when the drum 5 is rotated in the clockwise direction. The second guide 915*b* guides water, moved to the edge of the tub cover 43, to the discharge hole 913 when the drum 5 is rotated in the counterclockwise direction.

In the case where the discharge hole 913 is a single hole formed in the barrier 911, the respective guides 915*a* and 915*b* may guide water to the same discharge hole 913. However, in the case where the discharge hole 913 includes a first discharge hole 913*a* and a second discharge hole 913*b* formed in the barrier 911, the first guide 915*a* may guide water to the first discharge hole 913*a*, and the second guide 915*b* may guide water to the second discharge hole 913*b*.

Because the direction in which water moves along the first guide 915*a* is opposite to the direction in which water moves along the second guide 915*b*, the ejection unit 91 may wash the door 45 regardless of the direction in which the drum 5 is rotated so long as the number of revolutions per minute of the drum 5 is a predetermined reference number of revolutions per minute (e.g. the number of revolutions per minute by which the water inside the tub body 41 is moved upward to the tub cover 43).

In addition, the respective discharge holes 913*a* and 913*b* may be inclined at a prescribed angle so that the path of water discharged from the first discharge hole 913*a* and the path of water discharged from the second discharge hole 913*b* cross each other. This serve to increase the washing range of the discharge structure.

The ejection unit 91 having the configuration described above may be provided in a plural number along the edge of the introduction aperture 431, and the ejection units 91 may be arranged so as to surround the introduction aperture 431. In addition, at least two of the ejection units 91 may be arranged so as to face each other. This serves to increase the ability of washing by the discharge structure 91.

The ejection unit 93 illustrated in FIG. 8 has the feature of ejecting water supplied to the tub 4 to the door 45 so as to wash the door 45. The ejection unit 93 includes a chamber 931 for guiding water, supplied to the supply aperture 433 provided in the tub cover 43, toward the introduction aperture 431, and a chamber discharge hole 933 for discharging water introduced into the chamber 931 to the door 45.

The chamber 931 includes an inlet chamber 931*a* located under the supply aperture 433, and a connection chamber 931*b* for guiding water introduced into the inlet chamber 931*a* to the chamber discharge hole 933.

The inlet chamber 931*a* may have a communication hole 931*e* connected to the supply aperture 433. In order to increase the pressure of water to be discharged through the chamber discharge hole 933, the cross-sectional area of the connection chamber 931*b* may be smaller than the cross-sectional area of the inlet chamber 931*a*. In addition, the cross-sectional area of the chamber discharge hole 933 may be smaller than the cross-sectional area of the connection chamber 931*b*.

The connection chamber 931*b* may be tilted by a prescribed angle so that water ejected from the chamber discharge hole 933 is supplied to the door 45, which is located above the introduction aperture 431.

However, in the case where the door 45 includes the window 455, the tilt angle of the connection chamber 931*b* may be set to an angle at which water ejected from the chamber discharge hole 933 may be supplied to the window 455.

The inlet chamber 931*a* may further include an inlet chamber discharge, hole 935 for ejecting some of the water inside the inlet chamber 931*a* into the drum 5.

The inlet chamber discharge hole 935 may be provided so as to eject water toward the bottom surface 57 of the drum body, or may be provided so as to eject water toward the circumferential surface 55 of the drum body.

When the inlet chamber discharge hole 935 is provided so as to eject water toward the bottom surface 57 of the drum body, the inlet chamber discharge hole 935 may serve to remove bubbles generated inside the drum 5 by ejecting water into the drum 5 during washing.

That is, when the controller controls the water supply valve 77 during washing to supply water to the chamber 931, bubbles generate inside the tub 4 during washing are removed, which may prevent impurities, including the bubbles, from remaining on the door 45.

In some implementations, when the inlet chamber discharge hole 935 is provided so as to eject water toward the circumferential surface 55 of the drum body, the inlet chamber discharge hole 935 may serve to wash the circumferential surface 55 of the drum 5.

That is, when the controller controls the water supply valve 77 so as to supply water to the chamber 931 after washing is completed and also rotates the drum 5, impurities remaining on the surface of the drum 5 may be washed by water discharged from the inlet chamber discharge hole 935.

In addition, the connection chamber 931*b* may further have a connection chamber discharge hole 937 for discharging water to the drum 5.

At least two connection chamber discharge holes 937 may be provided. In some implementations, one connection chamber discharge hole 937 may be provided so as to discharge water toward the bottom surface 57 of the drum body, and the other connection chamber discharge hole 937 may be provided so as to discharge water toward the circumferential surface 55 of the drum body.

As is apparent from the above description, the present invention has the effect of providing a laundry treatment apparatus may have a minimum volume and may provide a space for installing a heater on the bottom surface of a tub.

In addition, the present invention has the effect of providing a laundry treatment apparatus may have a minimum volume and may ensure easy insertion of a heater into a tub.

In addition, the present invention has the effect of providing a laundry treatment apparatus may realize the simultaneous injection molding of a connector, which supports a tub, and a receiving portion, which provides a space for the installation of a heater.

In addition, the present invention has the effect of providing a laundry treatment apparatus may have a minimum volume and may increase the volume of a receiving portion that provides the space for the installation of a heater.

In addition, the present invention has the effect of providing a laundry treatment apparatus may prevent overheating of a heater and may prevent damage to the heater from the bottom surface of a drum while the drum is rotated.

In addition, the present invention has the effect of providing a laundry treatment apparatus may effectively control vibration of a tub in which laundry is received.

In addition, the present invention has the effect of providing a laundry treatment apparatus may prevent impurities, generated inside a tub during washing, from remaining on a door, which is used to open and close an introduction opening.

What is claimed is:

1. A laundry treatment apparatus comprising:

a housing;

a tub that is located inside the housing and that is configured to receive water;

a drum that is configured to rotate, that is located inside the tub, and that is configured to receive laundry;

a heater that is configured to heat water in the tub;

a tub through-portion (i) formed in the tub so that the heater is inserted into a space located between a bottom surface of the drum and a bottom surface of the tub and (ii) integrally provided with the tub:

three or more first support members that are located at the housing;

second support members that protrude from a circumferential surface of the tub and that are integrally formed with the tub, a number of the second support members being equal to a number of the three or more first support members; and a plurality of connectors that are each configured to connect a first support member and a second support member, wherein a second support member that is located closest to the tub through-portion protrudes from the circumferential surface of the tub in a direction that is parallel to a direction in which the heater is inserted into the tub through-portion.

2. The laundry treatment apparatus according to claim 1, further comprising:

a receiving portion protruding from the bottom surface of the tub so as to extend away from the bottom surface of the drum for providing a space in which the heater is received, the receiving portion having the tub through-portion therein.

3. The laundry treatment apparatus according to claim 2, wherein the tub through-portion is provided to be penetrated into a side surface of the receiving portion.

4. The laundry treatment apparatus according to claim 2, wherein the receiving portion is provided so that the direction in which the heater is inserted faces away from a center of rotation of the drum.

5. The laundry treatment apparatus according to claim 4, wherein the receiving portion is connected to a drain pipe that is configured to discharge water from the tub.

6. The laundry treatment apparatus according to claim 4, wherein the tub through-portion is located at an end of the receiving portion and is parallel to the bottom surface of the tub.

7. The laundry treatment apparatus according to claim 6, wherein the tub through-portion is located under the second support member that is located closest to the tub through-portion.

8. The laundry treatment apparatus according to claim 6, wherein the tub through-portion is located below and not directly under the second support member that is located closest to the tub through-portion.

9. The laundry treatment apparatus according to claim 6, wherein:

the receiving portion has a hexahedral shape, the tub through-portion has a rectangular shape, and the heater is "C"-shaped.

10. The laundry treatment apparatus according to claim 9, wherein each end of the heater protrudes out of the receiving portion through the tub through-portion.

11. The laundry treatment apparatus according to claim 1, further comprising a cabinet that defines a space configured to receive the housing, wherein the housing is configured to separate from the cabinet.

12. The laundry treatment apparatus according to claim 1, wherein the tub through-portion is provided to be penetrated into a side surface of the tub.

* * * * *